US006732652B2

(12) United States Patent
Loos et al.

(10) Patent No.: US 6,732,652 B2
(45) Date of Patent: May 11, 2004

(54) DEVICE FOR CLEANING A CYLINDER OF A PRINTING-MATERIAL PROCESSING MACHINE

(75) Inventors: Gerhard Loos, Mannheim (DE); Bernhard Seiwert, Edingen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/277,128

(22) Filed: Oct. 21, 2002

(65) Prior Publication Data

US 2003/0075065 A1 Apr. 24, 2003

(30) Foreign Application Priority Data

Oct. 19, 2001 (DE) ..... 101 51 673

(51) Int. Cl.[7] ..... B41F 35/00
(52) U.S. Cl. ..... 101/425; 101/423
(58) Field of Search ..... 101/425, 423, 101/424; 15/256.52, 256.51; 399/343, 352, 123, 34, 21, 35; 134/9

(56) References Cited

U.S. PATENT DOCUMENTS

| | | | | |
|---|---|---|---|---|
| 4,651,644 A | | 3/1987 | Kaempfe et al. | 101/423 |
| 4,867,064 A | | 9/1989 | Hara et al. | 101/425 |
| 4,966,074 A | * | 10/1990 | Aldrich, Jr. | 101/177 |
| 5,163,371 A | * | 11/1992 | Kotterer et al. | 101/484 |
| 5,372,290 A | * | 12/1994 | Marmin | 226/91 |
| 5,416,980 A | * | 5/1995 | Ilvespaa | 34/117 |
| 5,678,484 A | * | 10/1997 | Callan et al. | 101/226 |
| 6,161,477 A | * | 12/2000 | Hara et al. | 101/219 |

FOREIGN PATENT DOCUMENTS

| | | |
|---|---|---|
| DE | 35 29 865 A1 | 5/1986 |
| DE | 195 08 569 A1 | 11/1995 |
| EP | 0 291 745 A2 | 11/1988 |
| GB | 2 289 438 B | 11/1995 |

* cited by examiner

*Primary Examiner*—Anthony H. Nguyen
(74) *Attorney, Agent, or Firm*—Laurence A. Greenberg; Werner H. Stemer; Gregory L. Mayback

(57) ABSTRACT

A device for cleaning a cylinder of a machine for processing printing material includes a cleaning cloth pressable onto the cylinder for forming a contact zone. A first monitoring zone is monitorable with regard to a faulty position of the cleaning cloth, and is disposed downstream of the contact zone in a travel direction of the printing material. A second monitoring zone disposed upstream of the contact zone in the travel direction of the printing material is monitorable with regard to another faulty position of the cleaning cloth.

6 Claims, 4 Drawing Sheets

DEVICE FOR CLEANING A CYLINDER OF A PRINTING-MATERIAL PROCESSING MACHINE

BACKGROUND OF THE INVENTION

Field of the Invention

The invention relates to a device for cleaning a cylinder of a machine for processing printing material, having a cleaning cloth pressable onto the cylinder for forming a contact zone, and a first monitoring zone disposed downstream of the contact zone, in a travel direction of the printing material. The first monitoring zone is monitorable with regard to a faulty position of the cleaning cloth.

In particular, the machine for processing printing material is a rotary offset printing machine, and the cylinder is a blanket cylinder of the rotary offset printing machine.

During the cleaning of such a blanket cylinder, the cleaning cloth may remain stuck to the circumferential surface of the blanket cylinder and, because of the rotation of the blanket cylinder, may be pulled in a direction towards a cylinder nip formed by the blanket cylinder together with a printing plate cylinder. For the case wherein the cleaning cloth is, in fact, pulled into the cylinder nip, more or less critical complications have to be expected. Consequently, precautions should be taken for ensuring at least that the cleaning cloth is not pulled too deeply into the printing press and that the section of the cleaning cloth pulled into the cylinder nip is only a relatively short section, respectively.

The published European Application EP 0 291 745 B1, corresponding to U.S. Pat. No. 4,867,064, describes a device corresponding to the general type described at the introduction hereto, wherein the precautions required for protecting against the accident described hereinabove are taken. The device is equipped with a multifunctional element which, on the one hand, serves as a cutting blade for cutting up the cleaning cloth and, on the other hand, as a monitoring element for sensorially monitoring the monitoring zone lying between the contact zone and the cylinder nip. When such an accident occurs, the cleaning cloth is cut up by the multifunctional element and, thereby, the length of the section pulled into the cylinder nip is limited. In addition, the multifunctional element actuates an emergency stop switch which serves as a sensor and which prevents the section cut from the cleaning cloth from being pulled too deeply into the printing press, and by which assurance is provided that the section can be removed from the printing press again without very great effort.

The device operates reliably, however, only if the direction of rotation of the blanket cylinder, which is represented by an arrow A in FIG. 4*a* of the cited patent is maintained. If rotation should take place in the opposite direction of rotation, this would certainly rule out any possibility that the cleaning cloth adhering to the blanket cylinder would be pulled into the cylinder nip formed between the blanket cylinder and the printing plate cylinder, but instead, the danger would arise that the cleaning cloth might be pulled into another cylinder nip, specifically into the nip which is formed between the blanket cylinder and an impression cylinder. Changing the direction of rotation of the blanket cylinder during the progress of a cleaning program is therefore not possible for safety reasons. The precautions against the accident, which are associated with the device, are inadequate and permit only the rotation of the blanket cylinder to be performed in the rotational direction represented by the arrow A during the cleaning of the blanket cylinder.

SUMMARY OF THE INVENTION

It is accordingly an object of the invention to provide a cleaning device for a cylinder of a printing-material processing machine, which overcomes the hereinafore-mentioned disadvantages of the heretofore-known devices of this general type and which has improved precautions against accidents.

With the foregoing and other objects in view, there is provided, in accordance with the invention, a device for cleaning a cylinder of a machine for processing printing material, comprising a cleaning cloth pressable onto the cylinder for forming a contact zone. A first monitoring zone is monitorable with regard to a faulty position of the cleaning cloth. The first monitoring zone is disposed downstream of the contact zone in a travel direction of the printing material. A second monitoring zone is disposed upstream of the contact zone in the travel direction of the printing material. The second monitoring zone is monitorable with regard to another faulty position of the cleaning cloth.

In accordance with another feature of the invention, the cleaning device further comprises at least one monitoring element which, with a sensor coupled therewith, is assigned to the monitoring zones.

In accordance with a further feature of the invention, the sensor is assigned both to the first monitoring zone for registering the first-mentioned faulty position, and to the second monitoring zone for registering the other faulty position.

In accordance with an added feature of the invention, the monitoring element is a tensioning element.

In accordance with a concomitant feature of the invention, the tensioning element is formed with a deflection therein.

The object of the invention is thus attained by providing a device for cleaning a cylinder of a printed material processing machine having a contact zone. A first monitoring zone is disposed downstream from the contact zone in a travel direction of the printed material. The first monitoring zone is controlled or monitored by a sensor with regard to a first faulty position of the cleaning cloth. A second monitoring zone is disposed upstream from the contact zone in the travel direction of the printed material. The second monitoring zone is controlled or monitored by a sensor with regard to another faulty position of the cleaning cloth.

In the device according to the invention, the monitoring zones located on both sides of the contact zone are monitored by a sensor with respect to the faulty positions, for example loop formations, of the cleaning cloth which are typical of such faulty position accidents.

Thus, a change in the direction of rotation of the cylinder performed during the cleaning process is advantageously possible without risk. The change in the direction of rotation can be provided, for example, within the context of performing a washing process already described in the German Published Non-prosecuted Patent Application DE 195 08 569 A1, corresponding to the British Patent 2 289 438 assigned to the same corporate assignee as that of the instant application, the washing process being particularly thorough.

Various developments of the cleaning device according to the invention are possible:

For example, the first monitoring zone may have a first monitoring element assigned thereto, and the second monitoring zone may have a second monitoring element assigned thereto.

The first monitoring element can be coupled to a first sensor, and the second monitoring element can be coupled to a second sensor.

If contactless registration of the faulty positions is provided, the first monitoring zone can be monitored by a first light barrier and the second monitoring zone by a second light barrier. In this case, transmitters (radiation sources) of the light barriers function as the monitoring elements, and photoelectric receivers as the sensors. The transmitters and receivers, respectively, are coupled with one another by radiation and optically, respectively.

However, tactile registration or determination of the faulty positions can also be provided, by constructing the monitoring elements as contact elements. Contacts with the contact elements by the cleaning cloth effects a registration or determination of the faulty positions.

If the first monitoring zone has the first contact element and the first sensor assigned thereto, and the second monitoring zone has the second contact element and the second sensor assigned thereto, then the first contact element can be mechanically coupled with the first sensor, and the second contact element can be mechanically coupled with the second sensor.

Instead of the first sensor and the second sensor, however, only a single sensor assigned jointly to the contact elements can also be provided, with which each of the two contact elements is mechanically coupled.

Each of the two sensors and also the common sensor may be a displacement transducer or a force transducer or an electric switch.

Other features which are considered as characteristic for the invention are set forth in the appended claims.

Although the invention is illustrated and described herein as embodied in a device for cleaning a cylinder of a machine for processing printing material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
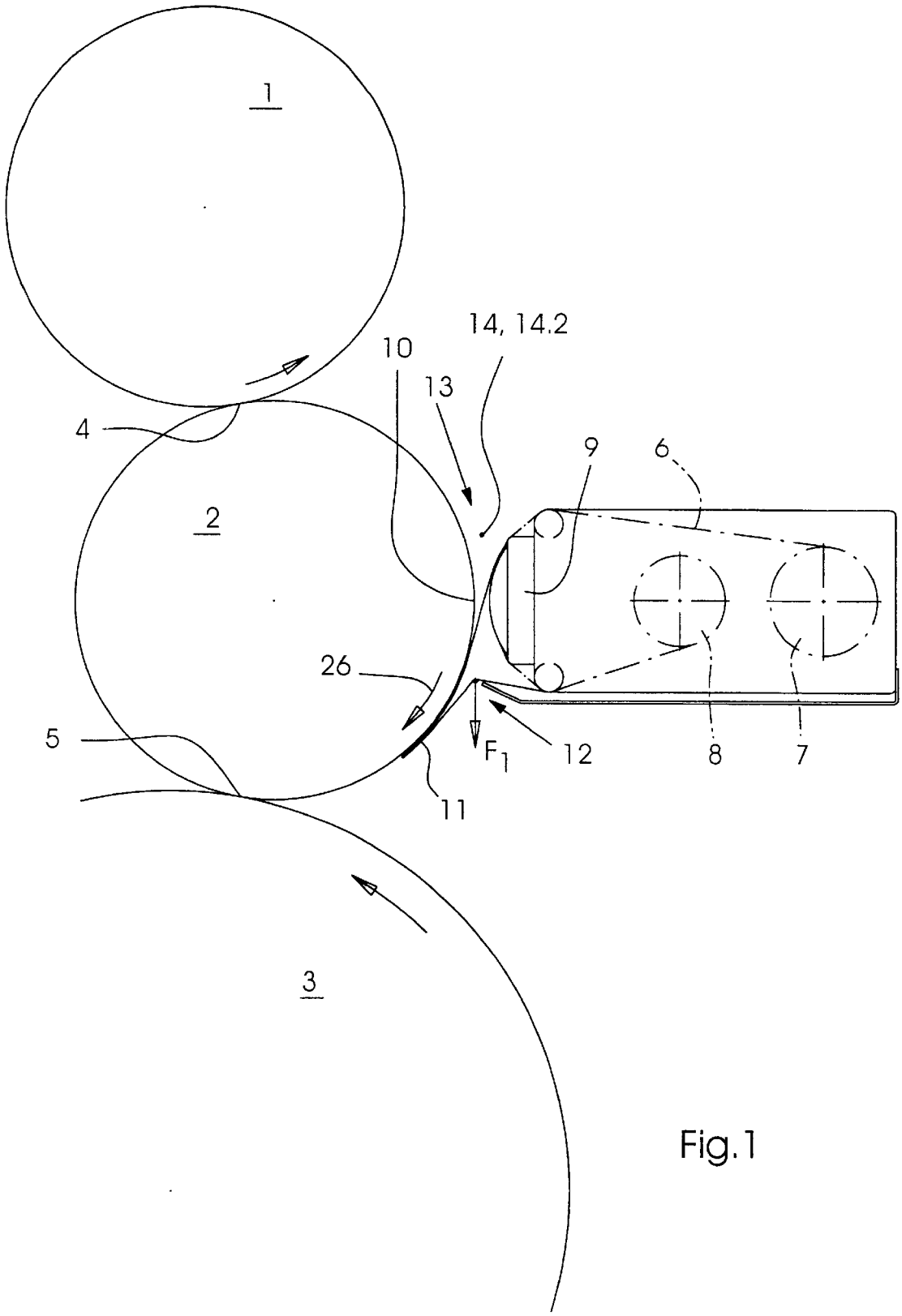
FIG. 1 is a fragmentary, diagrammatic, side-elevational view of a cleaning device with a cleaning cloth in a first faulty position.
Figure 2:
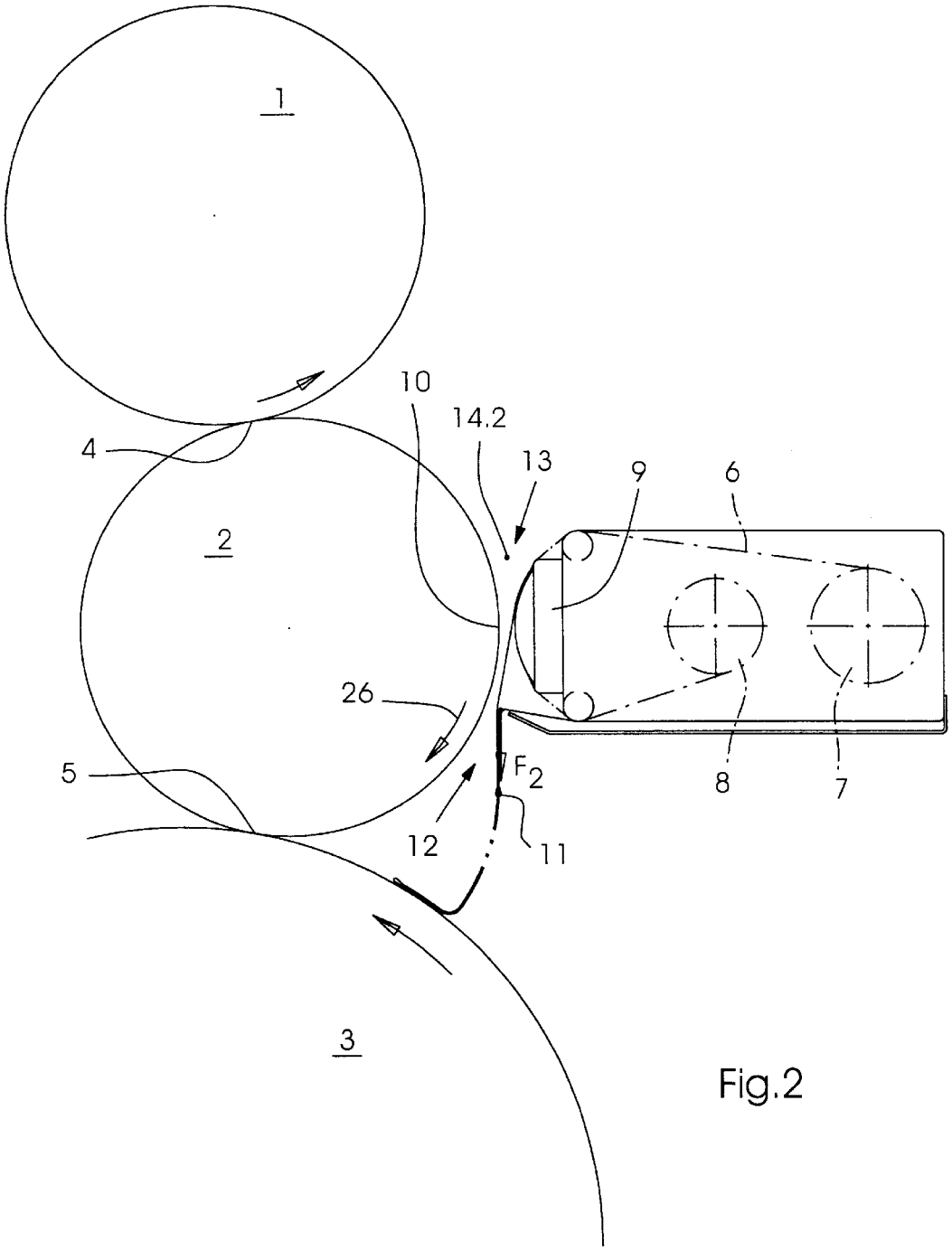
FIG. 2 is a view like that of FIG. 1 wherein the cleaning device with the cleaning cloth is in a second faulty position.
Figure 3:
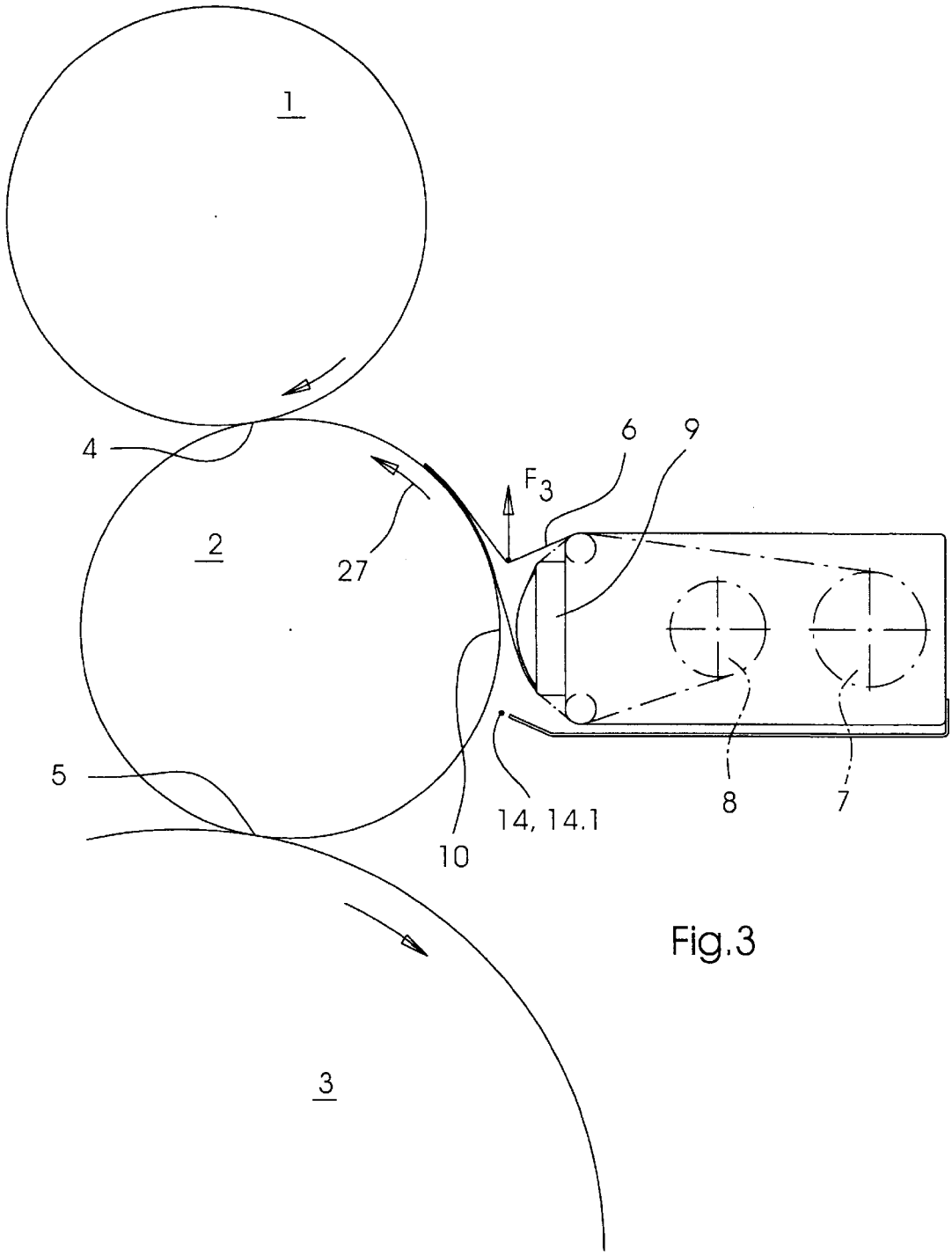
FIG. 3 is a view like those of FIGS. 1 and 2 wherein the cleaning device with the cleaning cloth is in a third faulty position.

Referring now to the figures of the drawings in detail and first, particularly, to FIGS. 1 to 3 thereof, there is shown a rotary offset printing machine including a printing plate cylinder 1, a blanket cylinder 2 and an impression cylinder 3. The blanket cylinder 2 and the printing plate cylinder 1 form a first cylinder nip 4 therebetween, and the blanket cylinder 2 and the impression cylinder 3 form a second cylinder nip 5 therebetween.

A cleaning device assigned to the blanket cylinder 2 for cleaning the latter includes a strip-like cleaning cloth 6, which is unwindable from a first roll 7 and is simultaneously windable up onto a second roll 8. The cleaning device is equipped with a pressing element 9 which serves for pressing a section of the cleaning cloth 6 lying between the rolls 7 and 8, in a contact zone 10, against the circumferential surface of the blanket cylinder 2, which rotates during the process. Due to the movement of the circumferential surface of the blanket cylinder 2 past the cleaning cloth 6, the surface is wiped off. By rotation of the rolls 7 and 8, regions of the cleaning cloth 6 which have already been soiled by relatively long use can be wound up onto the second roll 8 and, for the purpose of replacing the soiled regions, clean regions can be unwound simultaneously from the first roll 7.

Under contrary conditions, for example, when a very tacky printing ink layer is present on the blanket cylinder 2, the cleaning cloth 6 may remain stuck to the circumferential surface of the blanket cylinder 2 and, due to the rotation of the blanket cylinder 2, may be pulled in a direction towards one of the cylinder nips 4 and 5, respectively, and form a loop 11 (note FIGS. 1 and 3).

Should an accident monitoring device described further in detail hereinbelow not be present, various complications could result from the cleaning cloth 6 being pulled into one of the cylinder nips 4 and 5, respectively.

For one, the danger would arise that the cleaning cloth 6 would tear when pulled into the respective nip 4 or 5 and, as a result, become unusable.

For another, the much more critical danger would arise that the pulled-in cleaning cloth 6 would cause consequential accident within the printing press. For example, one could not exclude the possibility of a situation that might arise wherein the cleaning cloth 6 may be wound up on the blanket cylinder 2 and form a plurality of cloth layers on the blanket cylinder 2 which, altogether, are thicker than the cylinder nip 4 and, within the cylinder nip 4, press the cylinders 1 and 2 mutually apart to such an extent that a tolerable amount of cylinder bearing loading is exceeded and the cylinder bearings are consequently damaged.

In order to forestall the dangers described hereinabove, the cleaning device is equipped with the accident monitoring device.

A further accident registered by the accident monitoring device is illustrated in FIG. 2. The cause of this accident is not the sticking or adhesion of the cleaning cloth 6 to the blanket cylinder 2, but rather, a failure of one of the unwinding locks with which the rolls 7 and 8 are equipped. In order for the cleaning cloth 6 to be able to be wound not only from the first roll 7 onto the second roll 8 but also from the second roll 8 back again onto the first roll 7, each of the two rolls 7 and 8 is equipped with one of the unwinding locks.

In addition, there are yet other accidents which are not illustrated in the drawing but likewise registered by the accident monitoring device, wherein tearing of the cleaning cloth 6 is the cause.

The accident monitoring device is constructed as described hereinbelow:

A first monitoring zone 12 of the accident monitoring device is located between the contact zone 10 and the second cylinder nip 5, in a pocket formed between the cleaning device and the blanket cylinder 2. A second monitoring zone 13 is located between the contact zone 10 and the first cylinder nip 4, in a further pocket which is formed between the cleaning device and the blanket cylinder 2.

Figure 4:
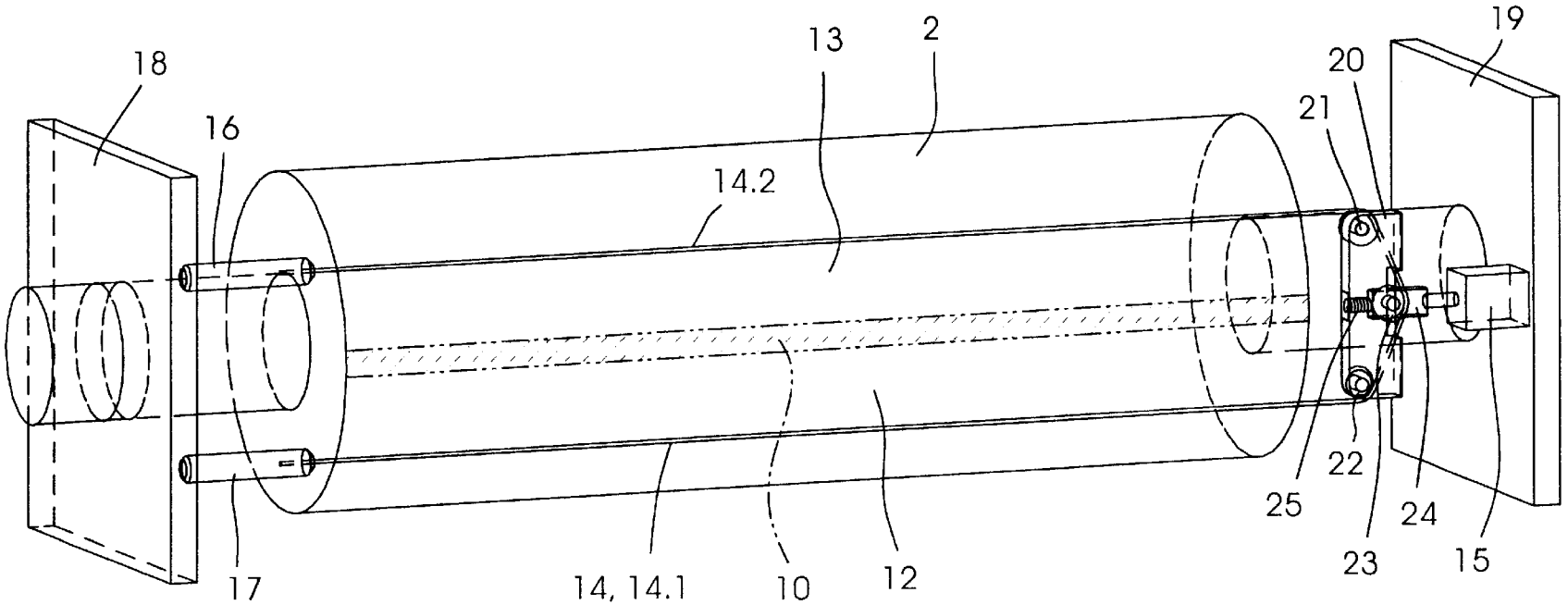
FIG. 4 is a perspective view of an accident control or monitoring device of the cleaning device.

As can best be seen in FIG. 4, a single monitoring element 14, which is coupled with a sensor 15, is assigned to the monitoring zones 12 and 13. A first section 14.1 of the monitoring element 14 extends in and along the first monitoring zone 12, and a second section 14.2 of the monitoring element 14 extends in and along the second monitoring zone 13. The sections 14.1 and 14.2 extend parallel to one another and to an axis of rotation of the blanket cylinder 2 but also beyond the two side edges of the cleaning cloth 6, the width of which corresponds at least approximately to that of the blanket cylinder 2.

The sensor 15 is an electric switch and may also be a displacement pick-up or transducer, instead. It is also conceivable to construct the sensor 15 as a force pick-up or transducer, in which case, an electronic control device containing the sensor 15 must also have a filter for filtering out oscillations of the monitoring element 14 and, therefore, of the sensor 15, which are caused by the operation thereof and are atypical accidents.

The monitoring element 14 is a flexible tensioning element, such as is also used in so-called flexible drive mechanisms. Strictly speaking, the monitoring element 14 is a wire. A strip (for example, a metal strip) or a thread (a plastic cord) or a multilink tensioning element (a chain) can likewise serve for forming the monitoring element 14.

The ends of the monitoring element 14 are enclosed by end pieces 16 and 17, respectively, and fixed to a side frame 18. The sensor 15 and a holder 20 with deflection rollers 21 and 22 are fitted to a side frame 19 opposite to the side frame 18. A further roller 23 is fixed to an actuating element 24 of the sensor 15. The monitoring element 14 extending deflectingly over the rollers 21 to 23 is under prestressing produced by a spring 25, the force of which acts upon the actuating element 24 and, therefore, upon the roller 23 which functions as a tensioning roller for tensioning the monitoring element 14.

The sensor 15 is assigned both to the first monitoring zone 12 for registering the first faulty position (note FIG. 1) and to the second monitoring zone 13 for registering the other faulty position (note FIG. 3) of the cleaning cloth 6, the two sections 14.1 and 14.2 of the monitoring element 14 being mechanically coupled with the sensor 15.

In the following text, the function of the accident monitoring device is described in terms of various accidents.

With regard to the accident illustrated in FIG. 1, the blanket cylinder 2 rotates in a first rotational direction represented by the arrow 26, and the cleaning cloth 6 remains stuck to the circumferential surf ace of the blanket cylinder 2, which is to be cleaned. In the event of failure of one of the unwinding locks of the rolls 7 and 8, respectively, or if the first roll 7 (the supply roll) is too-loosely wound, the cleaning cloth 6 is moved together with the blanket cylinder 2 in the rotational direction 26 of the latter. In this regard, a section of the cleaning cloth 6 located between the second roll 8 and the blanket cylinder 2 executes a movement that is typical for the accident and, as a result thereof, is laid on the monitoring element 14 and the first section 14.1, respectively. The closer the blanket cylinder 2 pulls the loop 11 in the direction towards the second cylinder nip 5, the higher a force $F_1$ exerted on the monitoring element 14 by the cleaning cloth 6 becomes, the monitoring element 14 being deflected or bent in the region of the first section 14.1 thereof. Due to increasing tensile stress in the monitoring element 14, the actuating element 24 is displaced counter to the action of the spring 25, i.e., is pulled out of the sensor 15. The displacement of the actuating element 24 has the effect of switching the sensor 15, by which a circuit belonging to the control or monitoring device containing the sensor 15 is closed and, virtually without any delay, an emergency stop signal is triggered, by which the rotation of the blanket cylinder 2 is stopped. The rotation is stopped so quickly that the cleaning cloth 6 has actually not yet been pulled into the second cylinder nip 5 at all. The section of the cleaning cloth 6 remaining stuck to the blanket cylinder 2 can be wound properly onto the second roll 8 after that section has been detached from the blanket cylinder 2. Due to the brief reaction time of the accident monitoring or control device, no tearing of the cleaning cloth 6 occurs and the latter can continue to be used after the accident has occurred.

It is typical for the accident illustrated in FIG. 2 that the cleaning cloth 6 does not stick to the circumferential surface of the blanket cylinder 2 but hangs down loosely from the cleaning device. In this regard, the cleaning cloth 6 is likewise in contact with the monitoring element 14 and the first section 14.1 thereof, respectively, so that the sensor 15 is actuated only by the weight $F_2$ of the loose loop 11 hanging down untensioned. Due to this actuation of the sensor 15, the cylinders 2 and 3 are stopped even before the loop 11, because of the faulty unwinding of the cleaning cloth 6, can lengthen to such an extent (note the phantom lengthening of the loop 11 in FIG. 2) that the cleaning cloth 6 would come into contact with the impression cylinder 3 and there would be a danger that the cleaning cloth 6 might be transported into the second cylinder nip 5 by the impression cylinder 3.

The accident according to FIG. 3 can result when the blanket cylinder 2 is rotated in a rotational direction represented by the arrow 27 opposite to the rotational direction 26 during cleaning. With regard to this accident, too, the cleaning cloth 6 is located in a faulty position, wherein the cleaning cloth 6 forms the loop 11 that remains stuck to the blanket cylinder 2. A section of the cleaning cloth 6, which is located between the pressing element 9 and the first roll 7 and which forms the loop 11, comes into contact with the monitoring element 14, more precisely with the second section 14.2, due to the rotation of the blanket cylinder 2 in the rotational direction 27, and exerts an increasing force $F_3$ on the second section 14.2, due to which the second section 14.2 is deflected or bent, and a tensile stress is caused in the monitoring element 14. The tensile stress effects a shortening of an existing spaced distance between deflection points which are formed by the rollers 21 and 23, and also of an existing spaced distance between deflection points which are formed by the rollers 22 and 23. In other words, because of the displacement (deflection) of the monitoring element 14, the roller 23 and, with the latter, the actuating element 24 are pulled closer to the rollers 21 and 22, counter to the action of the spring 25, and the sensor 15 is actuated so as to trigger the emergency stop signal. The sensor 15 triggers the emergency stop signal early enough to prevent the cleaning cloth 6 on the blanket cylinder 2 from being transported into the first cylinder nip 4.

If the sensor 15 is constructed as a displacement transducer or pick-up rather than as an electric switch, the control device assesses or evaluates an adjustment or actuating travel distance of the actuating element 24 and triggers the emergency stop signal as soon as the actuating travel distance has exceeded a specific limiting value.

If the sensor 15 is constructed as a force transducer or pick-up, the control device assesses or evaluates a force exerted on the sensor 15 by the monitoring element 14, and the control device triggers the emergency stop signal as soon as the force has exceeded a specific limiting value. When the force transducer is used, it is also advantageous if the control device contains an electronic filter which filters out interference signals resulting from oscillations of the monitoring element 14, which are caused by a cylinder gap formed in the rotating blanket cylinder 2, so that unintended triggering of the emergency stop signal by the oscillations of the monitoring element 14 is ruled out.

Of course, the cleaning device equipped with the accident monitoring device can also serve for cleaning a cylinder other than the blanket cylinder 2, for example, for cleaning an inking roller.

Likewise, the cleaning device can be assigned to the impression cylinder 3 which, together with a sheet transport cylinder, forms a third cylinder nip therebetween. In this case, the accident monitoring device rules out both the pulling of the cleaning cloth 6 into the second cylinder nip and the pulling of the cleaning cloth 6 into the third cylinder nip.

We claim:

1. A device for cleaning a cylinder of a machine for processing printing material, comprising:

a cleaning cloth to be pressed onto the cylinder for forming a contact zone;

a first monitoring zone to be sensor-monitored with regard to a first faulty position of said cleaning cloth, said first monitoring zone disposed downstream of said contact zone in a travel direction of the printing material; and a second monitoring zone disposed upstream of said contact zone in said travel direction of the printing material, said second monitoring zone to be sensor-monitored with regard to a second faulty position of said cleaning cloth.

2. A device for cleaning a cylinder of a machine for processing printing material, comprising:

a cleaning cloth being pressed onto the cylinder for forming a contact zone;

a first monitoring zone being sensor-monitored with regard to a first faulty position of said cleaning cloth, said first monitoring zone disposed downstream of said contact zone in a travel direction of the printing material;

a second monitoring zone disposed upstream of said contact zone in said travel direction of the printing material, said second monitoring zone being sensor-monitored with regard to a second faulty position of said cleaning cloth;

at least one monitoring element associated with said monitoring zones; and a sensor coupled with said at least one monitoring element.

3. The cleaning device according to claim 2, wherein said sensor is associated with both said first monitoring zone for registering said first faulty position and said second monitoring zone for registering said second faulty position.

4. The cleaning device according to claim 2, wherein said monitoring element is a tensioning element.

5. The cleaning device according to claim 4, wherein said tensioning element is formed with a deflection therein.

6. The cleaning device according to claim 2, wherein said at least one monitoring element is two monitoring elements.

* * * * *